US007644552B2

(12) United States Patent
Kuipers et al.

(10) Patent No.: US 7,644,552 B2
(45) Date of Patent: Jan. 12, 2010

(54) GLASS PANEL ARRANGEMENT

(75) Inventors: Shane Kuipers, Zeeland, MI (US); Dan Van Huis, Ludington, MI (US); Peter Beyer, Holland, MI (US); Mike Sheedlo, Pullman, MI (US)

(73) Assignee: Haworth, Inc., Holland, MI (US)

( * ) Notice: Subject to any disclaimer, the term of this patent is extended or adjusted under 35 U.S.C. 154(b) by 1996 days.

(21) Appl. No.: 09/773,285

(22) Filed: Jan. 31, 2001

(65) Prior Publication Data

US 2002/0100236 A1 Aug. 1, 2002

(51) Int. Cl.
*E04B 2/76* (2006.01)
*E04C 2/38* (2006.01)

(52) U.S. Cl. ..... 52/481.2; 52/239; 52/204.71; 52/786.13; 52/656.5; 52/800.12

(58) Field of Classification Search ..... 52/238.1, 52/243, 220.7, 36.4–36.5, 221, 241, 126.2, 52/126.3, 481.2, 202, 204.71, 716.8, 656.5, 52/656.6, 800.12, 800.14, 800.15, 239, 786.13
See application file for complete search history.

(56) References Cited

U.S. PATENT DOCUMENTS 3,158,909 A * 12/1964 Downs ..... 52/202
3,195,698 A * 7/1965 Codrea ..... 52/731.5
4,114,331 A * 9/1978 Yamamoto ..... 52/202
4,631,881 A * 12/1986 Charman ..... 52/220.7
4,631,894 A * 12/1986 Jerila ..... 52/800.13
4,685,255 A * 8/1987 Kelley ..... 52/36.1
4,716,698 A * 1/1988 Wilson et al. ..... 52/239
4,795,355 A * 1/1989 Dorn et al. ..... 439/215
4,876,835 A * 10/1989 Kelley et al. ..... 52/239
4,918,886 A * 4/1990 Benoit et al. ..... 174/48
5,038,539 A * 8/1991 Kelley et al. ..... 52/239
5,433,046 A * 7/1995 Mcquarrie et al. ..... 52/238.1
5,860,264 A * 1/1999 Gephart et al. ..... 52/656.4
5,899,025 A * 5/1999 Casey et al. ..... 52/36.1
6,065,249 A * 5/2000 Gephart et al. ..... 49/425
6,158,179 A * 12/2000 Ackerly et al. ..... 52/220.7
6,276,102 B1 * 8/2001 Shipman et al. ..... 52/220.7
6,282,854 B1 * 9/2001 Vos et al. ..... 52/239
6,405,504 B1 * 6/2002 Richardson ..... 52/461

* cited by examiner

*Primary Examiner*—Robert J Canfield
(74) *Attorney, Agent, or Firm*—Flynn, Thiel, Boutell & Tanis, P.C.

(57) ABSTRACT

A space-dividing wall panel has glass panels mounted on opposite faces of the wall panel to permit viewing therethrough. Each glass panel is defined by a sheet of glass and edge rails extending about the periphery of the glass. The edge rails include fixing channels on opposite sides thereof which are press-fit onto respective edges of the glass without the use of a resilient gasket within the fixing channel.

27 Claims, 10 Drawing Sheets

GLASS PANEL ARRANGEMENT

FIELD OF THE INVENTION

The invention relates to a space-dividing wall panel as used in office areas and, more particularly, to a wall panel having glass panels which permit viewing therethrough.

BACKGROUND OF THE INVENTION

Space-dividing wall panels are typically used in open office areas to subdivide a large office area into multiple workstations, meeting areas and the like. Most wall panels in a typical office area are covered on opposite sides thereof with solid cover panels so that the wall panel defines a physical and visual barrier as may be desired between adjacent workstations.

In some instances, however, it is desirable to be able to provide the wall panel with a window or define a glass wall that separates adjacent areas physically but not visually.

One example of a space-dividing wall panel is disclosed in U.S. Pat. No. 4,876,835 that discloses a portion of a wall panel having a glass tile that is mountable to the structural framework of the wall panel. The glass tile has a section of glass supported within a rectangular frame which frame is relatively large and obtrusive due to the thickness thereof.

In view of the foregoing, it is an object of the invention to provide a see-through wall panel which supports a glass panel thereon that has an improved visual appearance while using a reduced number of parts.

Generally, the invention relates to a see-through wall panel having a rectangular interior frame and glass panels supported on the opposite faces of the panel frame. Each glass panel includes a sheet of glass and vertical and horizontal edge rails which are mounted to the peripheral edges of the glass. While it is known to use elastomeric gaskets on window panes such as in fixed residential or office building windows, the edge rails in the inventive wall panel do not support the glass thereof through a gasket. Rather, in the preferred embodiment, the edge rails on opposite edges of the glass panel include elongate fixing channels in which respective sections of the edge of the glass are received and supported without a gasket therein.

More particularly, the fixing channel in a particular edge rail is defined by outer and inner channel walls which are dimensioned to tight-fittingly receive the glass edge therein. At least one of the channel walls is resiliently deflectable to effectively define a cantilevered spring or jaw which acts against an opposing face of the glass so that the channel walls grip the glass within the channel. The deflectable channel wall generally extends parallel to the face of the glass and has a projection which projects in the direction of glass so that the channel wall preferably contacts the glass face solely through the projection. This reduces the contact area of the deflectable channel wall on the glass face.

As referenced above, the edge of the glass is tight-fittingly received within the fixing channel wherein the deflectable channel wall is deflectable to a relatively small extent to allow insertion of the glass edge and tight-fitting gripping thereof.

While each edge rail preferably is formed of aluminum, it is preferable that the rail material be powder coated although this is not required for suitable gripping of the glass edge. Nevertheless, it is found that the thickness of the glass edge may vary due to tolerances in the glass. As a result, upon insertion of the glass within the rail channel, the edge of the glass may shave off some of the powder coating such that the powder coating serves to accommodate glass tolerances and maintain uniform contact between the glass face and the deflectable channel wall along the length of the fixing channel.

With this arrangement as described in more detail herein, it is possible to minimize the edge rail thickness since only a small portion of the glass is received within the rail channels. This allows the exposed area of the glass to be maximized which thereby provides an improved aesthetic appearance. Furthermore, gaskets are not required in the rail channel which further simplifies construction and assembly.

Other objects and purposes of the invention, and variations thereof, will be apparent upon reading the following specification and inspecting the accompanying drawings.

DETAILED DESCRIPTION OF THE DRAWINGS

Figure 17:
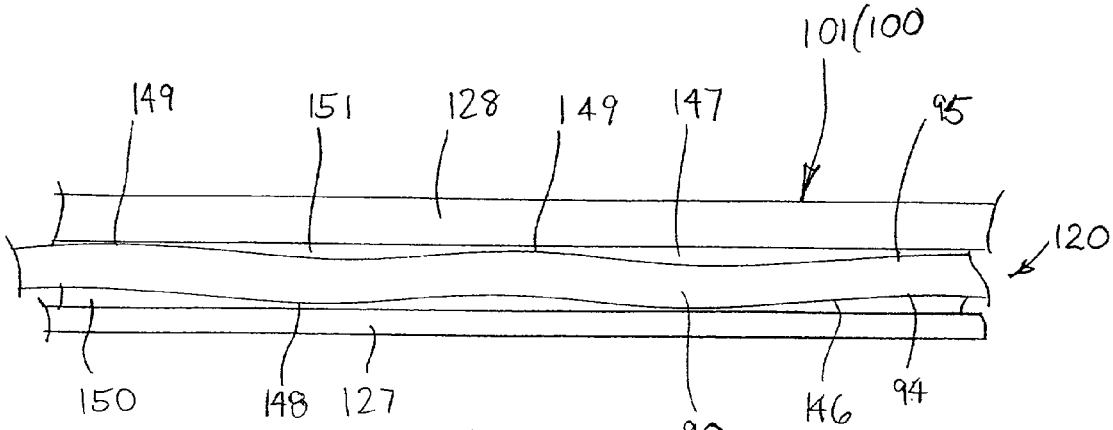

FIG. 17 diagrammatically illustrates the effect of glass tolerances on a powder coating.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 1:
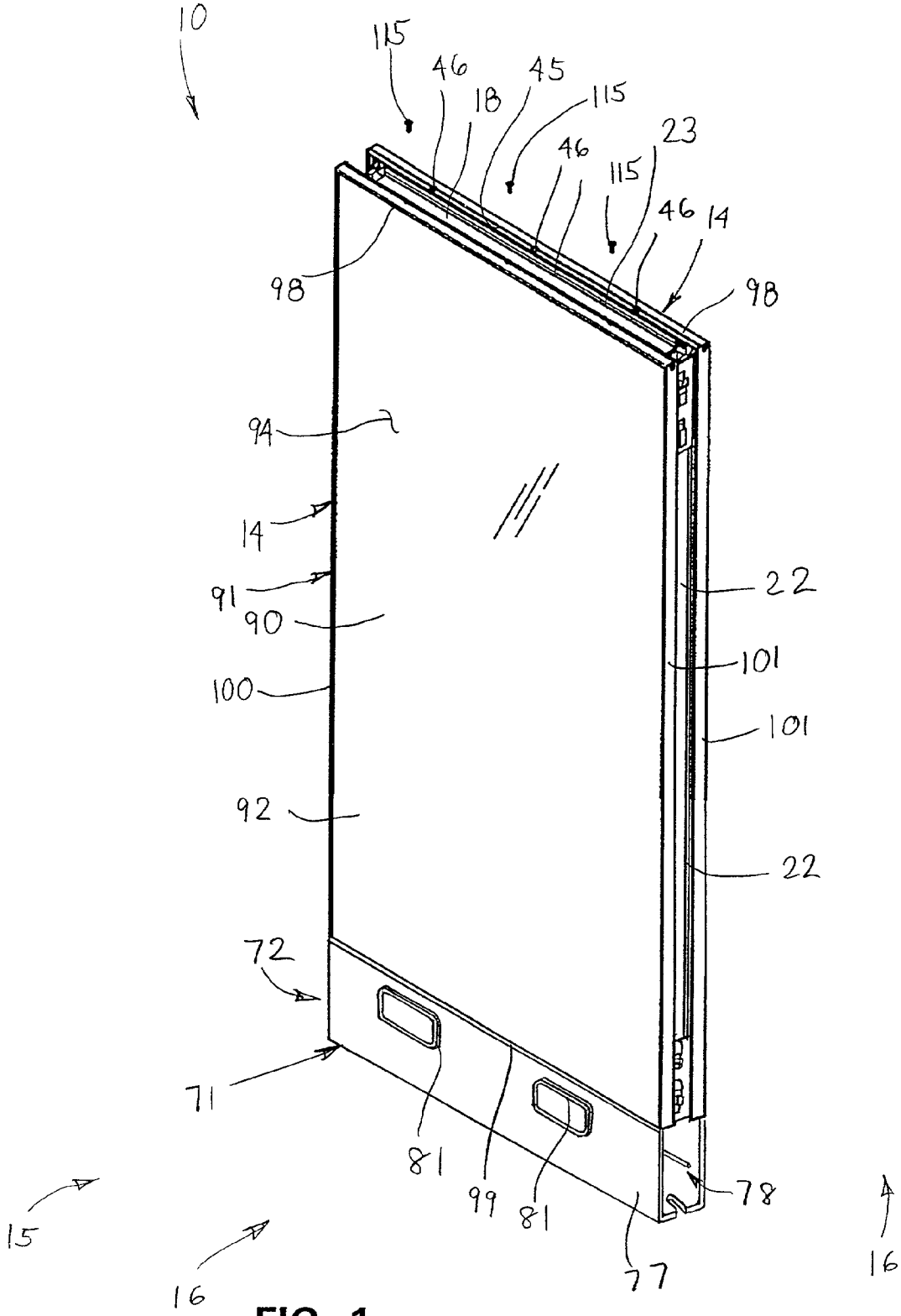
FIG. 1 is a perspective view of a see-through wall panel.
Figure 2:
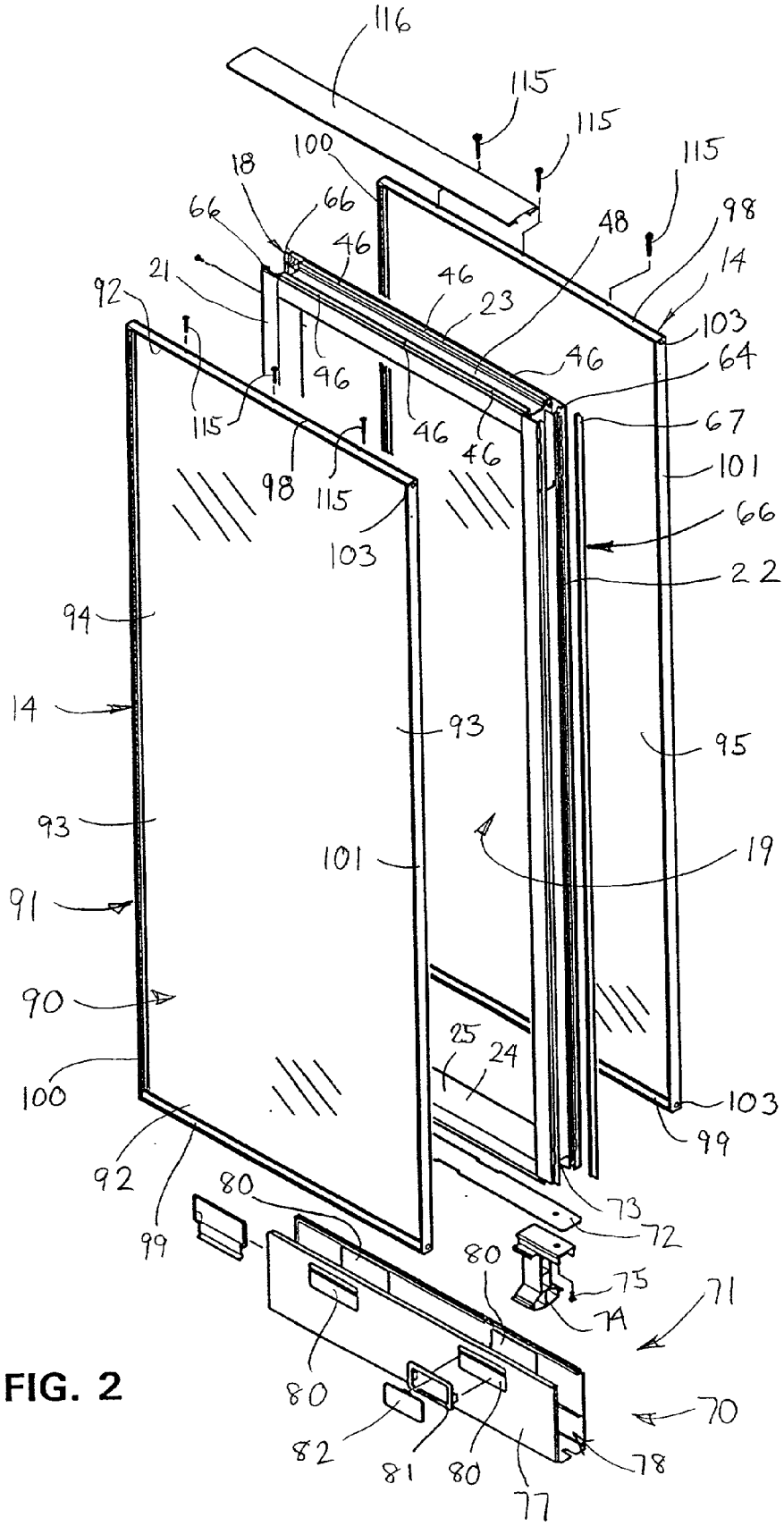
FIG. 2 is an exploded perspective view of the wall panel.

Referring to FIGS. 1 and 2, the invention relates to a space-dividing wall panel 10 which includes glass panels 14 mounted to the opposite sides thereof. As will be described herein, the glass panels 14 have an improved construction which improves the manufacture and aesthetic appearance thereof.

Generally as seen in FIG. 1, the wall panel 10 is used to physically subdivide an office area 15 into separate areas 16 for use as workstations, meeting rooms, hallways and the like. Accordingly, the wall panel 10 physically separates the areas 16 one from the other. However, while some conventional wall panels are provided with solid cover panels for visual privacy, the wall panel 10 includes glass panels 14 so that the wall panel 10 is see-through and thereby provides a more visually open office area.

The wall panel 10 is adapted to be used in combination with additional wall panels to subdivide the office area 15 as mentioned above. Such additional wall panels can be solid wall panels such as an existing line of wall panels sold by the assignee hereof, Haworth, Inc., under the trademark PREMISE, wherein the solid wall panels provide physical and visual separation of the work areas 16. Alternatively, wall panels 10 can be joined together to define a glass-walled area 16. The general use of solid wall panels and wall panels having windows therein is known and a more detailed discussion thereof is not required herein. Rather, the following discussion is directed to the construction of the inventive wall panel 10.

Figure 4:
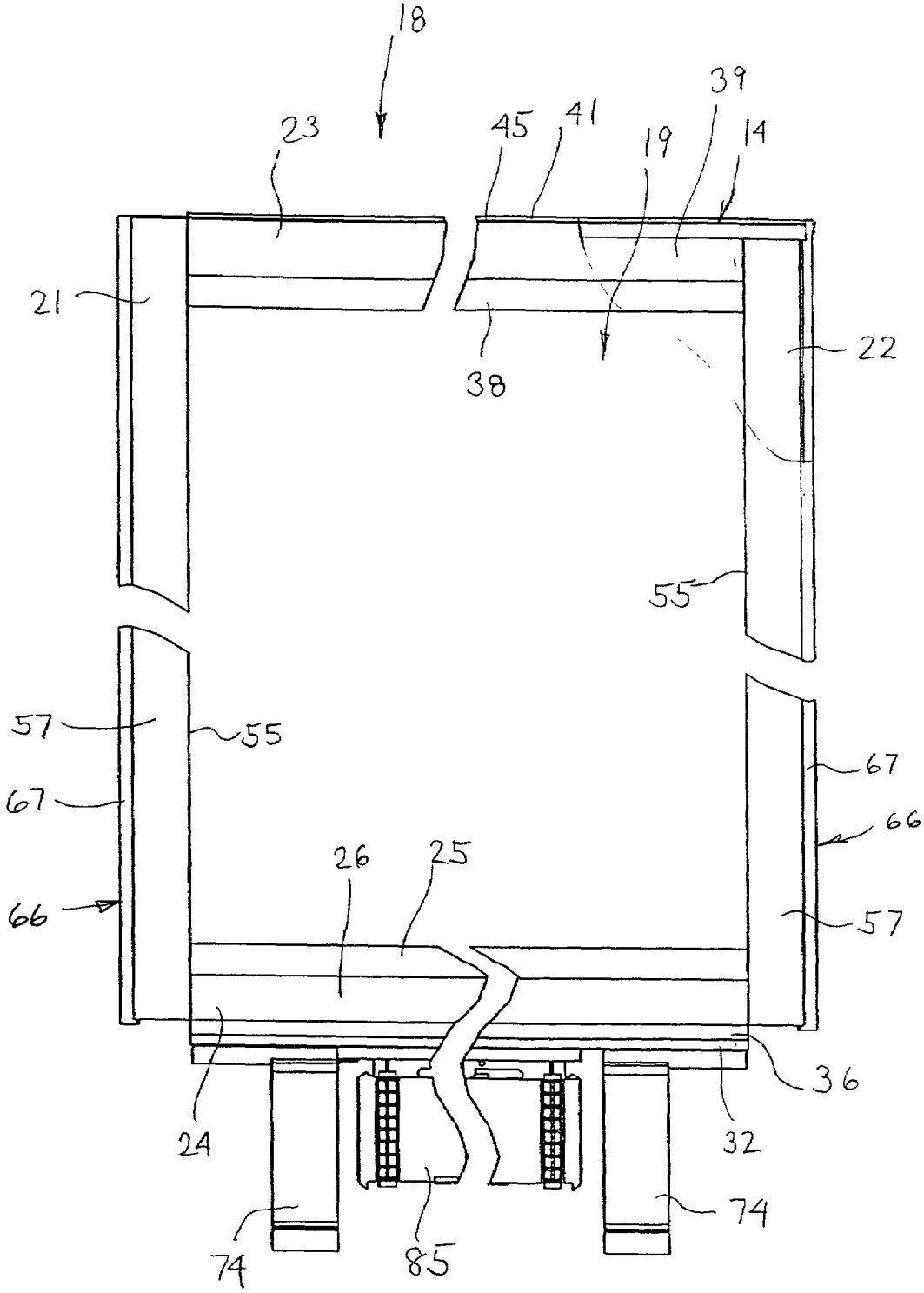
FIG. 4 is a broken front elevational view of the wall panel frame.

More particularly, the wall panel 10 includes an interior panel frame 18 which has a rectangular shape and defines an opening 19 through the open interior area thereof. Referring to FIGS. 2 and 4, the panel frame 18 is defined by vertical frame members 21 and 22 and upper and lower frame members 23 and 24 respectively which are joined together in a rectangular arrangement. This rectangular arrangement defines the opening 19.

Figure 7:
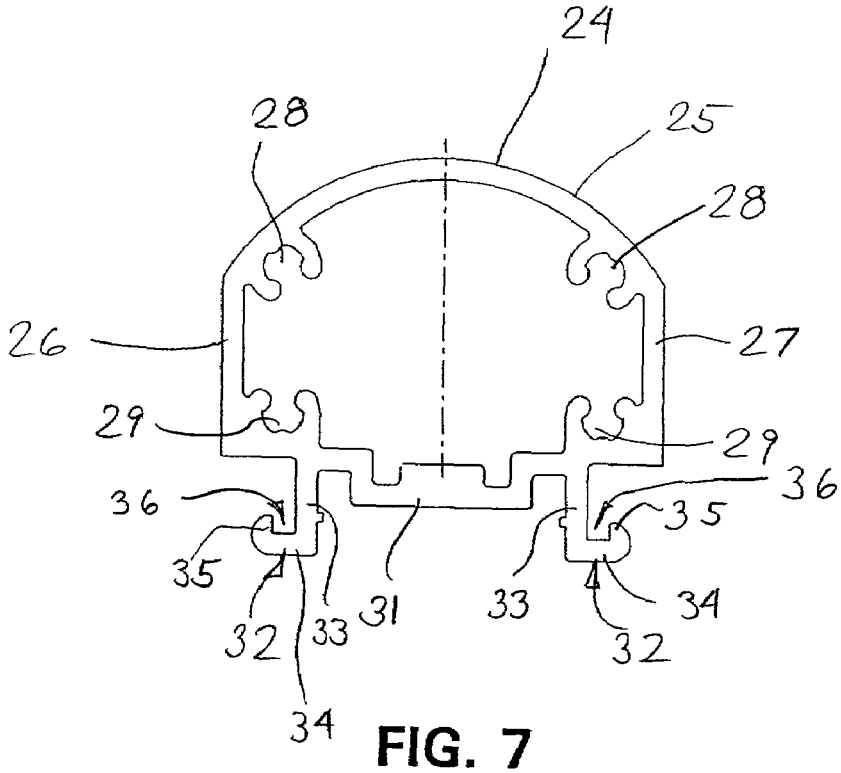
FIG. 7 is an end view of a lower frame member.

The bottom frame member 24 as illustrated in FIGS. 4 and 7 is formed of extruded metal and extends transversely across the bottom of the frame 18. The frame member 24 has an interior upper surface 25 which is arcuate and faces upwardly into the interior region of the frame 18 to thereby define the lower edge of the opening 19.

The side walls 26 and 27 are formed with ribs that project inwardly to define upper screw bores 28 and lower screw bores 29. The lower frame member 24 also includes a bottom wall 31 generally between the lower screw bores 29.

To support the glass panels 14, a pair of support flanges 32 project downwardly from the bottom wall 31. The flanges 32 are generally L-shaped and are defined by a vertical leg 33, a horizontal leg 34 and a lip 35 which projects upwardly from the outer edge of the horizontal leg 34. The flanges 32 thereby define horizontal slots 36 which extend along the transverse length of the frame member 24 on the opposite sides thereof.

Additionally, the frame member 24 is powder coated or has another suitable aesthetic finish. As such, the side walls 26 and 27 and the arcuate upper surface 25 define exposed surfaces which are visible through the glass panels 14. As such, this frame member 24 as well as the remaining frame members 22, 23 and 24 do not require additional trim pieces that might otherwise be required to define the visible surfaces of the panel frame 18.

Figure 5:
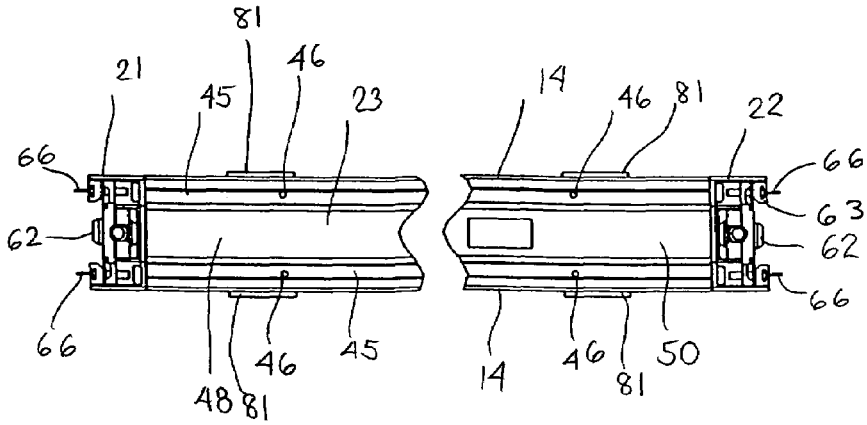
FIG. 5 is a plan view of the wall panel frame.
Figure 8:
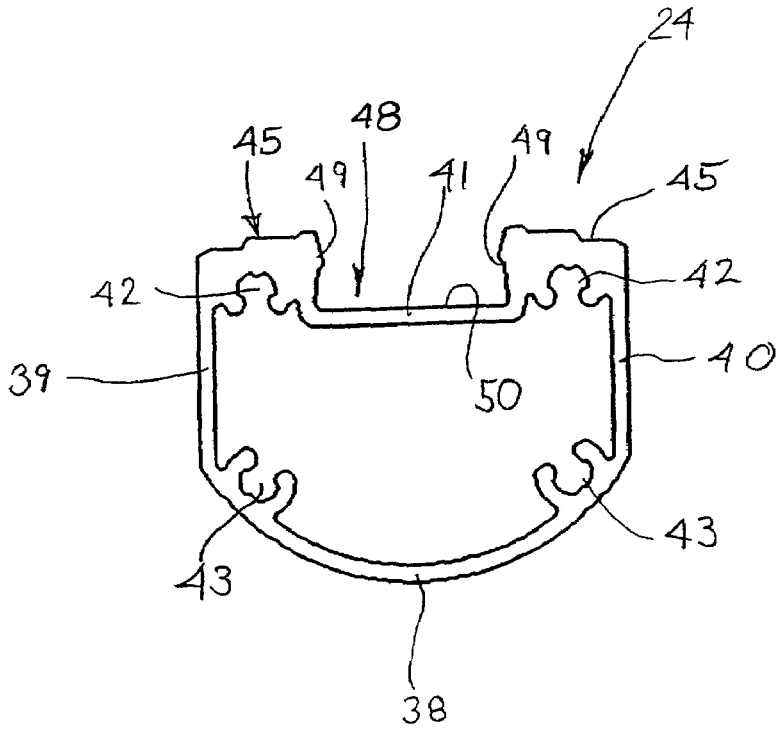
FIG. 8 is an end elevational view of an upper frame member.

Referring to FIGS. 4, 5 and 8, the upper frame member 23 is formed similar to the lower frame member 24. In particular, the upper frame member 23 is formed of extruded metal or other suitable rigid material. The frame member 24 has a tubular shape defined by a lower wall having an interior lower surface 38, opposite side walls 39 and 40 and an upper wall 41. The side walls 39 and 40 and the lower surface 38 have an aesthetic finish such as powder coating since these surfaces also are visible through the glass panels 14 as seen in FIG. 4.

To secure the upper frame member 23 to the vertical frame members 21 and 22, the upper frame member 23 includes ribs that project inwardly to define upper and lower pairs of screw bores 42 and 43 respectively (FIG. 8) in the opposite ends thereof.

To support the glass panel 14, the upper wall 41 has a stepped shape defined by mounting shoulders 45 which are spaced apart from each other in parallel relation. Each mounting shoulder 45 includes a plurality of screw holes 46 (FIGS. 3 and 5) which are spaced apart on each shoulder 45 in the transverse direction. The screw holes 46 are provided to engage the upper edges of the glass panels 14 as will be described herein.

The mounting shoulders 45 furthermore define a central horizontal channel 48 (FIGS. 6 and 8) extending transversely along the length of the upper frame member 23. The channel 48 is defined by channel sides 49 and a channel bottom 50.

Figure 6:
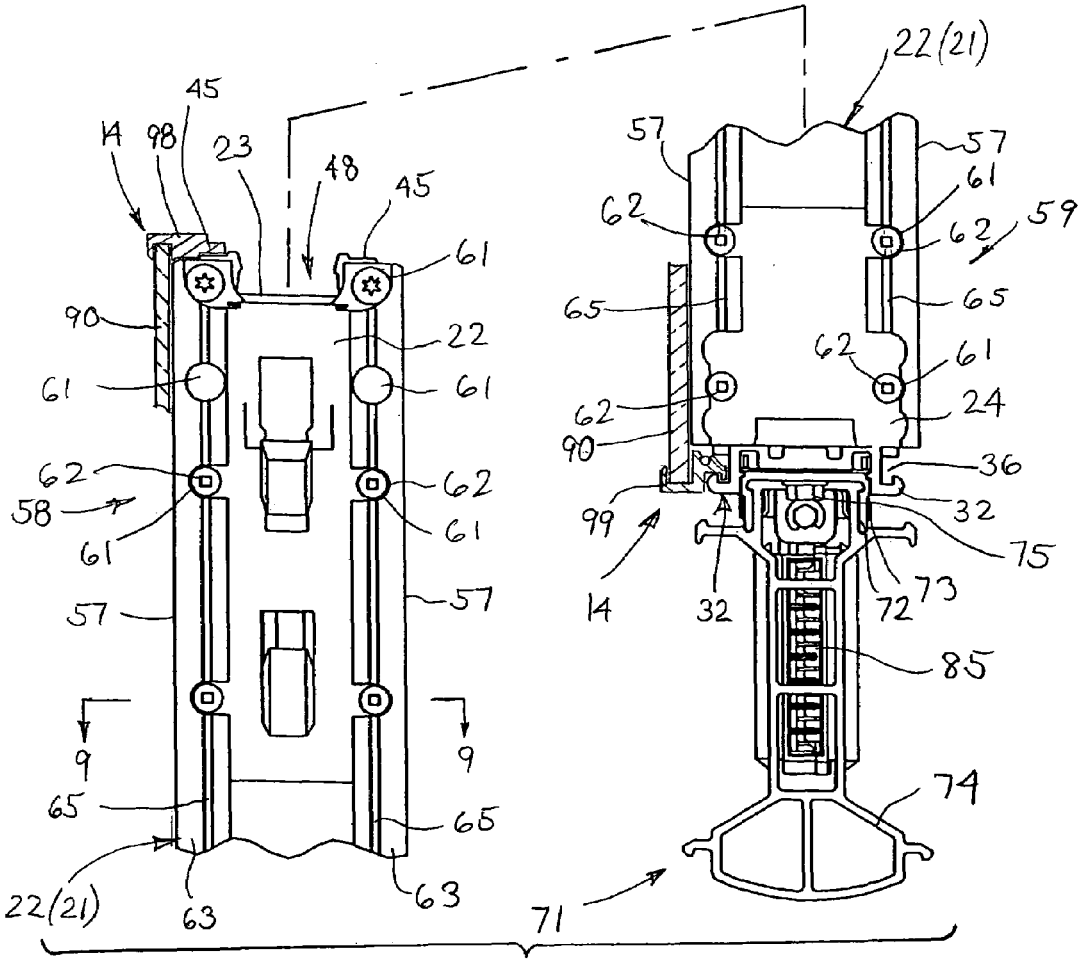
FIG. 6 is a partial and elevational view of the wall panel frame.

Referring to FIGS. 4, 5 and 6, the vertical frame members 21 and 22 are formed identical to each other except that the frame members 21 and 22 face in opposite directions when connected together with the upper and lower frame members 23 and 24. Generally, the upper and lower ends of the vertical frame members 21 and 22 are joined to the respective opposite ends of the horizontal frame members 23 and 24 to define the rectangular frame 18.

Preferably, the frame 18 is free of additional structure in the open interior region between the frame members 21 to 24 to define the opening 19 which opens therethrough. It will be understood, however, that the open interior region may include, for example, a decorative or solid panel to enclose the opening 19. The decorative panel could be visible through the glass panels 14 to provide a visual barrier that has a different visual effect than that provided by conventional solid wall panels which typically have an outer skin covered by an aesthetic covering such as fabric, wood or the like.

Figure 9:
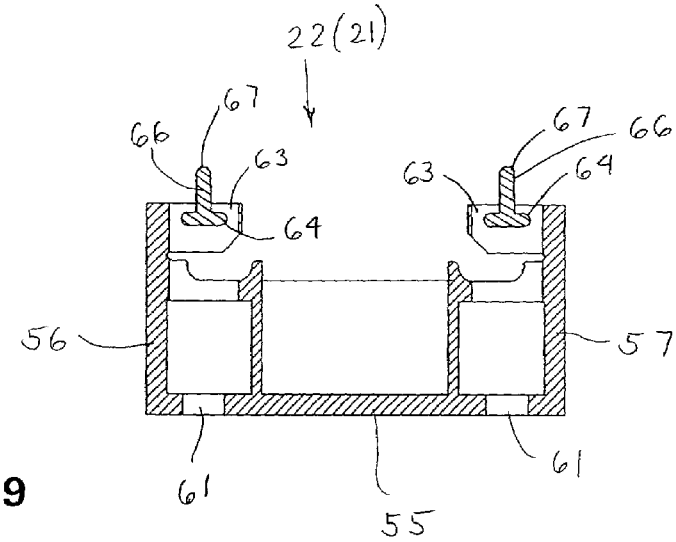
FIG. 9 is a top cross-sectional view of a vertical frame member as taken along line 9-9 of FIG. 6.
Figure 10:
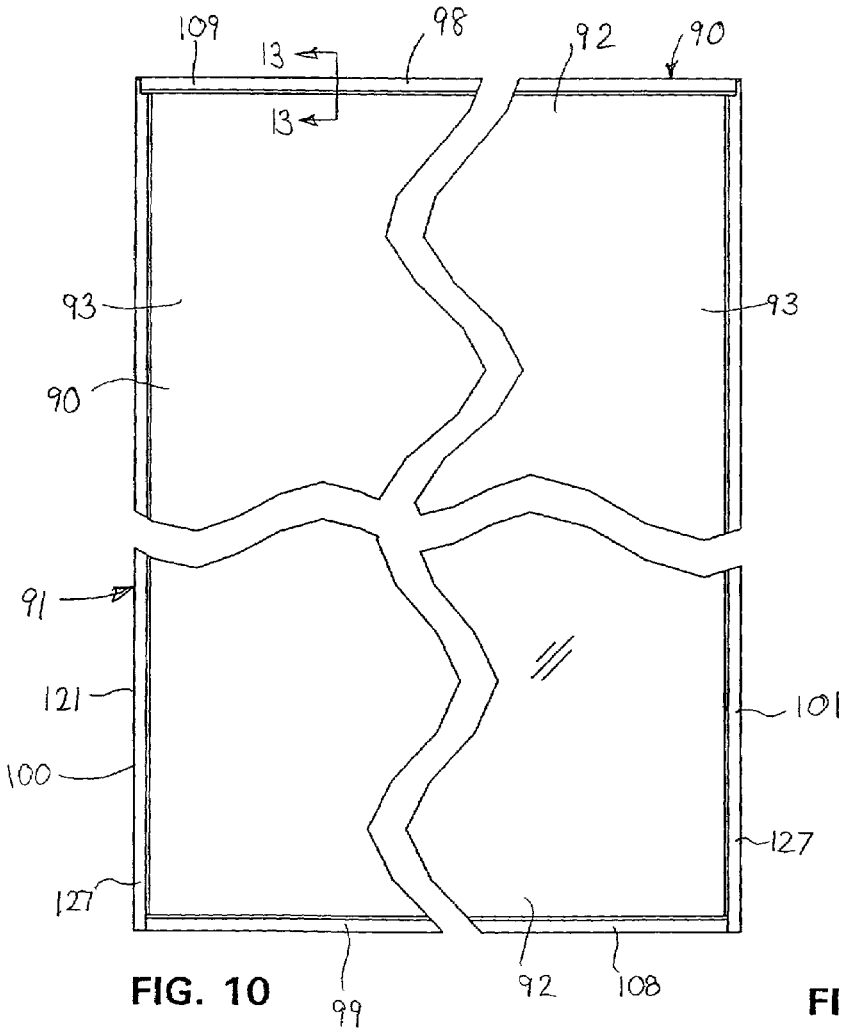
FIG. 10 is a broken front elevational view of the glass panel.

More particularly, as to the vertical frame members 21 and 22, the following discussion is directed to the frame member 22 as illustrated in FIG. 9. However, the opposite frame member 21 is identical and thus, the following reference numerals are also used for frame member 21 and a separate discussion thereof is not required.

The frame member 22 (21) includes an interior wall 55 and side walls 56 and 57 which are all provided with a finished exterior surface since these surfaces will be visible during use.

The upper end 58 and the lower end 59 of the frame member 22 are each provided with screw holes 61 to permit fastening of the upper and lower ends 58 and 59 to the adjacent ends of the upper and lower frame members 23 and 24. The screw holes 61 in the lower end 59 align with the pairs of screw bores 28 and 29 in the respective end of the lower frame member 24, while the screw holes 61 in the upper end 58 align with the screw bores 42 and 43 in the respective end of the upper frame member 24. The adjacent ends of the frame members 21, 22, 23 and 24 thereby are aligned one with each other, and thereafter the screws 62 are screwed through the holes 61 into the aligned bores 28, 29, 42 and 43 to join the frame members 21 to 24 into the rectangular configuration.

The frame member 22 also includes gasket mounts 63 adjacent each side wall 56 and 57. The gasket mounts 63 each include a T-shaped gasket slot 64 extending along the vertical length of the frame member 22. The gasket slot 64 has an opening 65 which extends intermittently along the length thereof (due to the presence of the screw holes 61) and opens sidewardly.

A gasket 66 having a corresponding T-shape is slidably fitted vertically into one of the open ends of the gasket slot 64. Since the slot 64 is spaced outwardly of the holes 61, the gasket 66 is able to slide past the screws 62. The gasket 66 includes a gasket lip 67 which projects outwardly of the slot opening 65 and is provided to sealingly engage the glass panel 14 as will be described herein to prevent migration of dirt and the like into the open interior region of the panel frame 18.

Additionally, the wall panel 10 is adapted to route cabling such as for electrical power to a workstation 16 and accordingly, the panel frame 18 includes a raceway 70 at the bottom end thereof. Referring to FIGS. 2, 4 and 6, the raceway 70 includes a raceway cover arrangement 71 that defines a horizontally elongate open channel in which cabling can be received.

More particularly, the cover arrangement 71 includes a horizontal generally U-shaped mounting channel 72 which fits within a corresponding groove 73 that is formed on the bottom surface of the lower frame member 24. The mounting channel 72 is adapted to receive therein a pair of support posts 74 which are fixed to the lower frame member 24 by respective fasteners 75 and project downwardly therefrom.

The mounting post 75 is adapted to receive a raceway cover 77 thereon which cover 77 is generally U-shaped and defines the raceway channel 78 within the hollow interior thereof. The raceway cover 77 includes outlet openings 80 which openings 80 are adapted to receive a bezel 81 and bezel cover 82 for access to conventional electrical receptacles.

As illustrated in FIGS. 4 and 6, a power distribution assembly 85 also is mounted to the mounting channel 72 transversely between the mounting posts 74. The power distribution assembly 85 is conventional and thus, a more detailed description of the power distribution assembly 85 and the associated raceway arrangement 71 is not required.

Referring more particularly to the glass panels 14, the glass panels 14 are each formed from a sheet of glass 90 and an edge rail frame 91 which supports the periphery of the glass sheet 90. The glass panel 14 is adapted to be secured at the top and bottom edges thereof to the respective upper and lower frame members 23 and 24 of the panel frame 18 so as to close off the open interior region of the panel frame 18.

More particularly, the sheet of glass is square cut to define a plurality of glass edges 92 and 93. Preferably, the glass 90 has a rectangular shape defined by a vertically spaced apart pair of horizontal top and bottom glass edges 92 which are substantially parallel to each other, and by a laterally spaced apart pair of vertical side glass edges 93. As discussed herein, at least the vertical glass edges 93 preferably are parallel to each other since these glass edges 93 are compression fit into the edge rail frame 91.

The glass preferably has a thickness of 0.130±0.010 inches. With this arrangement of the edge rail frame 91 and the glass 90, the glass thickness used herein is less than the glass thickness typically used in the furniture industry which provides a further weight and cost advantage.

Figure 13:
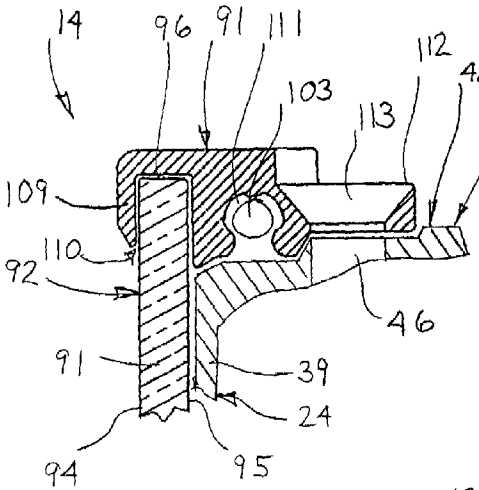
FIG. 13 is a side cross-sectional view of the glass panel as taken along line 13-13 in FIG. 10.
Figure 15:
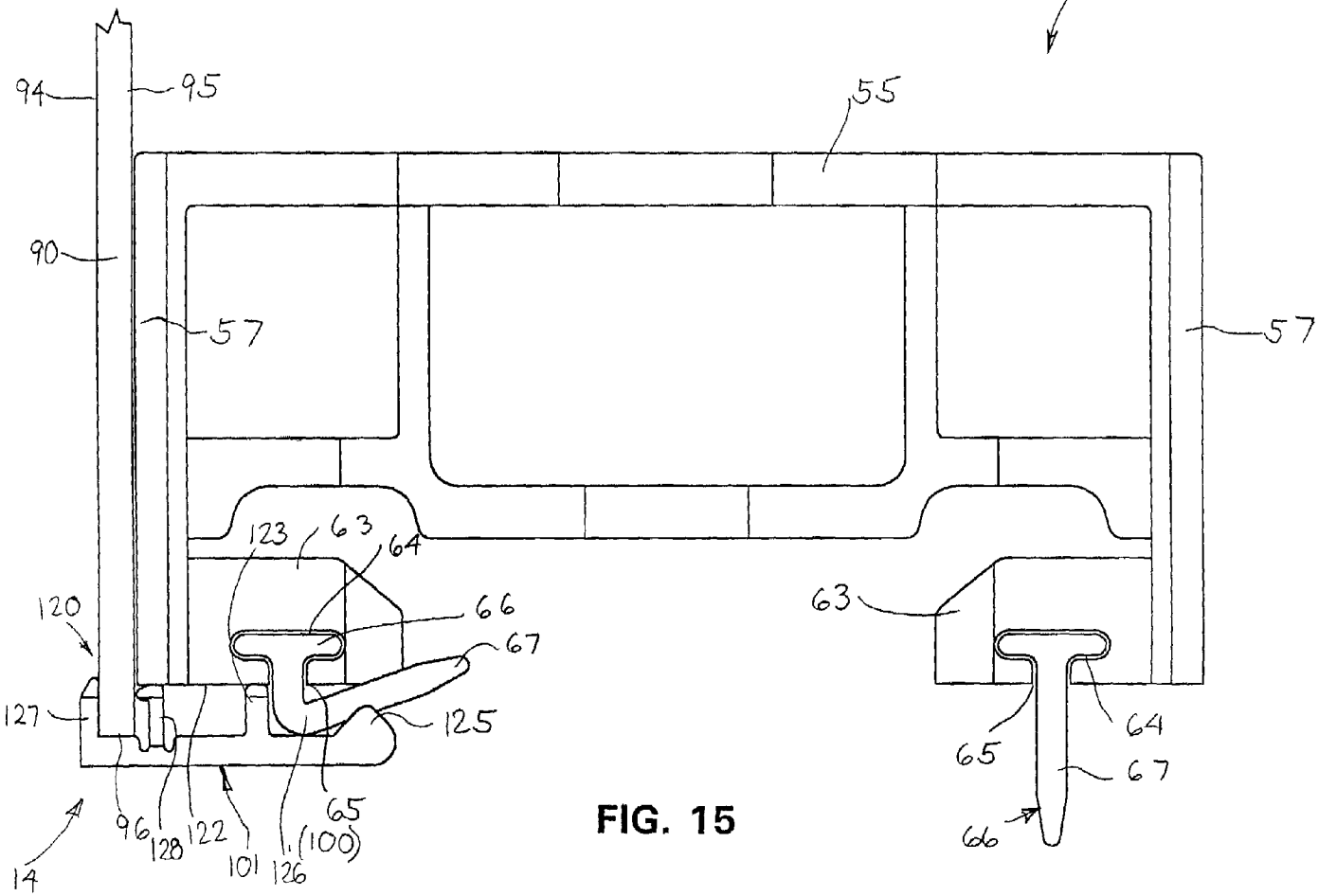
FIG. 15 is a plan view of one vertical frame member with the glass panel mounted thereto.

More specifically, the thickness of the glass is defined between the outer glass face 94 and the inner glass face 95 as generally illustrated in FIGS. 13 and 15. Further, each of the edge sections 92 and 93 terminates at a glass end face 96 which extends around the entire periphery of the glass 90.

The glass 90 as used in the glass panel 14 preferably is tempered glass and the aesthetic appearance thereof may be varied. For example, in some applications it may be desirable to provide smoked glass while in other cases it may be desirable to use clear glass, etched glass or even glass having imprinting thereon.

As to the construction of the rail frame 91, a plurality of edge rails are joined together in a rectangular configuration and more particularly the rail frame 91 comprises an upper edge rail 98, a bottom edge rail 99 which is substantially parallel to the upper edge rail 98, and a pair of parallel vertical edge rails 100 and 101 which extend vertically between the upper and lower edge rails 98 and 99. Each of the edge rails 98, 99, 100 and 101 are formed of extruded powder coated aluminum as described in further detail herein. The individual edge rails 98 to 101 are joined together at the corners of the glass frame 91 by fasteners 103.

Figure 3:
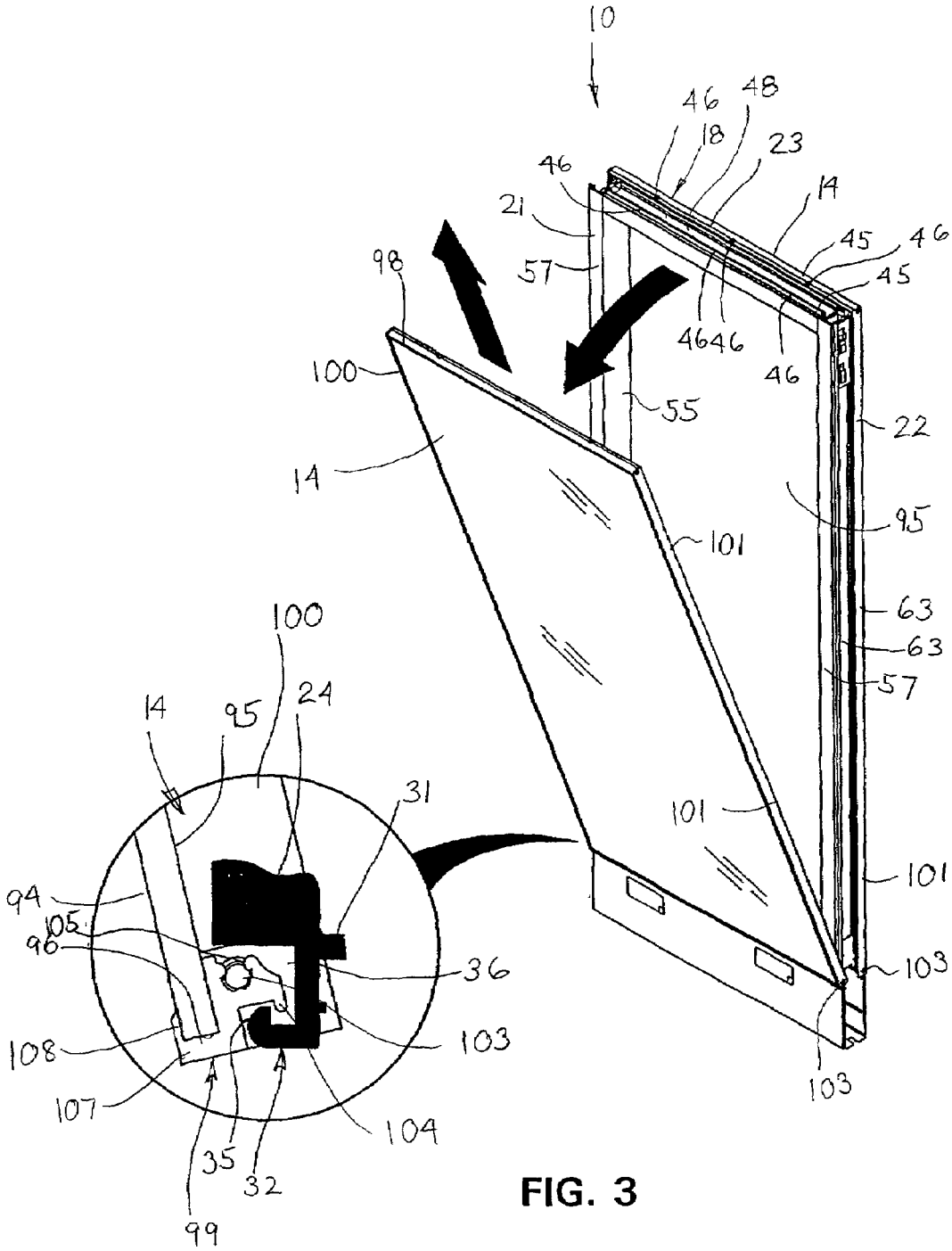
FIG. 3 is a front perspective view illustrating a glass panel being tilted outwardly therefrom for removal.

As to the bottom edge rail 99, the cross-sectional shape of the bottom edge rail 99 is illustrated in FIG. 3. The bottom edge rail 99 extends horizontally and includes a hook 104 along the transverse length thereof which projects downwardly and inwardly towards the panel frame 18. The hook 104 is adapted to hook into the support flange 31 defined on the bottom of the horizontal frame member 24.

Furthermore, fastener bores 105 are provided at the opposite ends of the edge rail 99. To support the glass 90, the bottom edge rail 99 includes a support channel 107 which extends horizontally along the lateral length thereof and opens upwardly to receive the bottom edge region 92. The support channel 107 includes an upstanding outer wall 108 which confines the lower glass edge therein.

Figure 12:
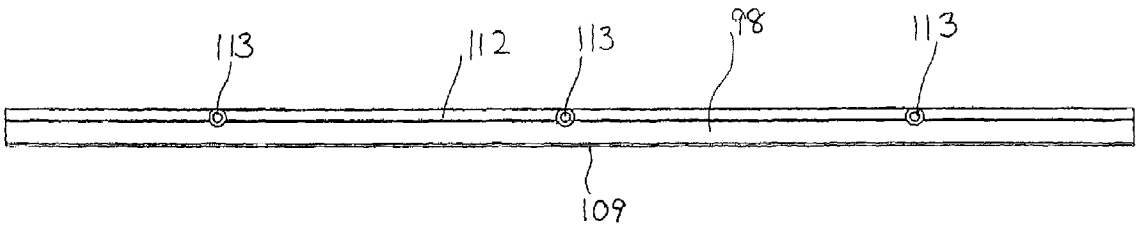
FIG. 12 is a plan view of the glass panel.

Referring to FIGS. 12 and 13, the upper edge rail 98 also is horizontally elongate and has a channel wall 109 which defines a downward opening channel 110 along the lateral length thereof for receiving the uppermost edge of the glass 91. Notably both the lower support channel 107 and the upper support channel 110 are dimensioned to be slightly greater than the thickness of the glass 91 so as to provide a snug but still readily removable fit between the upper and lower edge rails 98 and 99 and the respective upper and lower edges of the glass 91.

The upper edge rail 98 further includes a fastener bore 111 at each opposite end thereof for connection to the side rails 100 and 101. Furthermore, the upper edge rail 98 includes a flange 112 which projects rearwardly so as to overlie the mounting shoulders 45 on the upper frame member 23. The mounting flange 112 includes a plurality of fastener holes 131 projecting vertically therethrough which holes 113 are adapted to be aligned with the corresponding fastener holes 46 formed in the upper frame member 23.

During assembly, the glass panel 90 is first hooked onto the lower frame member 24 by engaging the hook 104 with the corresponding flange 32 and then the upper edge of the glass panel 90 is pivoted about the flange 104 generally backwardly toward the wall panel frame 18. Once the glass panel 14 lies against the panel frame 18, the mounting flange 113 on the top edge rail 98 overlies the mounting shoulder 45. Thereafter, suitable fasteners 115 are engaged through the mounting holes 113 and 46 to secure the top edge of the glass panel 14 in place. Thereafter, an appropriate plastic top cap 116 (FIG. 2) is snapped into the central channel 48 of the upper frame member 23 to cover the fasteners 115 and provide an aesthetic, finished appearance for the wall panel 10.

Figure 11:
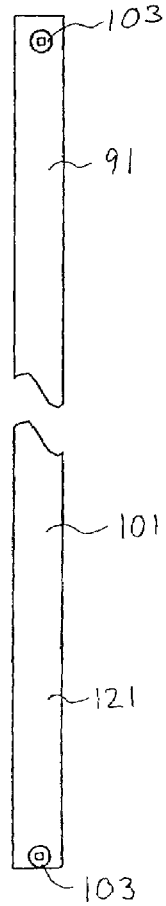
FIG. 11 is a right side elevational view of the glass panel.
Figure 14:
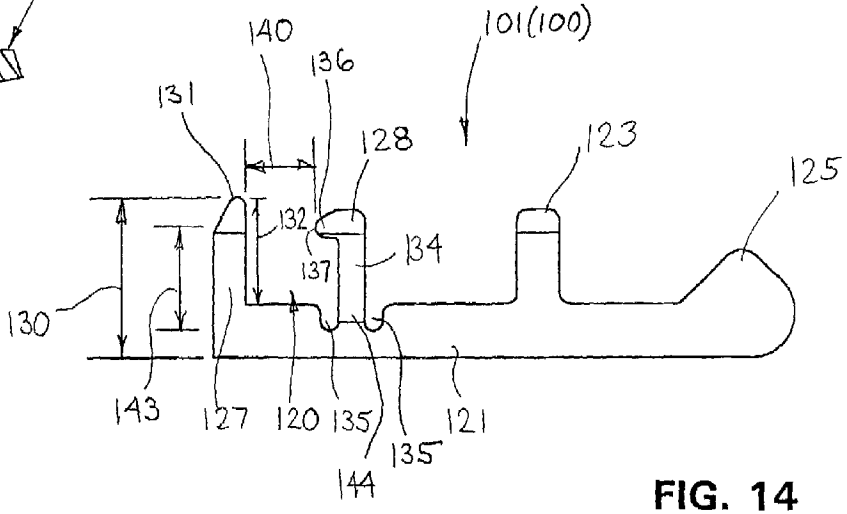
FIG. 14 is an enlarged plan view of a vertical edge rail of the glass panel.

Referring to FIGS. 11, 14 and 15, the opposite side edge rails 100 and 101 are formed identical to each other except that these components have a reverse orientation. Thus, the following discussion is primarily directed to the right edge rail 101 although it is understood that this discussion is equally applicable to the left edge rail 100 and as such, identical reference numerals are used to identify the same features on both of the edge rails 100 and 101.

Generally, the upper and lower ends of each edge rail 101 includes fastener holes therethrough which allow the fasteners 103 to be inserted therethrough into threaded engagement with either the respective fastener bore 105 of the lower edge rail 99 (FIG. 3) or the fastener bore 111 in the upper edge rail 98 (FIG. 13). Thus, the corners of the edge rail frame 91 are joined together by the corner fasteners 103 so that the horizontal upper and lower edge rails 98 and 99 and the vertical side rails 100 and 101 are fixedly joined together in a rectangular configuration.

To support the glass 90, each of the side edge rails 101 or 100 includes a fixing channel 120 that extends vertically along the vertical length thereof and opens sidewardly to receive the respective glass edge section 93 therein. While a more detailed discussion of this engagement is provided hereinafter, generally, the glass edges 93 are tight-fittingly received within the fixing channel 120 without the use of separate gaskets and accordingly, the fixing channel 120 provides rigid support to the vertical glass edge regions 93.

More particularly, the edge rail 101 (100) includes a sidewall 121 which extends rearwardly and is adapted to be disposed outwardly of the side faces 122 of the vertical frame members 21 and 22. Thus, as the glass panel 14 is swung upwardly to the mounted position illustrated in FIG. 1, the sidewall 121 engages the gasket 66 adjacent thereto. Referring to FIGS. 14 and 15, the edge rail 101 is provided with a rib 123 which extends along the vertical length of the side edge rail 101 and projects sidewardly towards the frame face 122. The rib 123 generally serves as a locator rib to roughly align the glass panel 14 sidewardly adjacent to the vertical frame members 21 and 22 during installation.

The side wall 121 also includes a shorter ridge or bead 125 which extends along the vertical length of the edge rail 101 and projects sidewardly although the height of the ridge 125 is less than the height of the locator rib 123. When fully installed, the rib 125 contacts the gasket lip 67 and pushes the lip 67 rearwardly as illustrated in FIG. 15. When the glass panel 14 is fully seated in place, the ridge 125 moves past a bend 126 which forms in the gasket lip 67.

Due to the amount of material confined at the bend 126, the bend 126 effectively defines a catch for the ridge 125 which serves to positively restrain the side edge rail 101 in the fully seated position illustrated in FIG. 15. Furthermore, the gasket 67 serves as a seal to prevent migration of dust, dirt and the like into the hollow interior region of the panel frame 18. In this manner, the glass 90 is pulled closely against the opposing walls of the panel frame 18.

More particularly as to the fixing channel 120, the fixing channel 120 is defined by an upstanding exterior channel wall 127, an interior deflectable channel wall 128 and a channel end face 129 that is defined by the side wall 121.

Specifically, the exterior channel wall 127 projects upwardly from the side wall 121 and preferably has a dimension of approximately 0.25 inches as indicated by dimension line 130 in FIG. 14. Dimension line 130 represents the overall exterior thickness of the edge rail 101 which thereby provides an improved visual appearance to minimize the overall noticeability of the edge rail 101. This quarter inch dimension of the reveal is also used on the upper and lower edge rails 98 and 99 so that a consistent 0.25 inch reveal is used on the rail frame 91.

The distance between the outer distal tip 131 of the outer channel wall 127 and the channel end face 129 is indicated by dimension line 132. This represents the depth of the fixing channel 120 and is the maximum depth that the glass edge 93 may be inserted therein. This distance is selected so that it is great enough that upon bowing of the glass 90 which may occur during normal use, the glass edge does not slide out of the fixing channel 120.

As for the deflectable channel wall 128, this channel wall effectively defines a cantilevered spring force which serves to grip the glass edge 93. In particular, the channel wall 128 includes a cantilevered section 134 having an interior base end which is integrally formed with the side wall 121. The cantilevered section 134 is resiliently deflectable away from the fixed exterior channel wall 127, and to facilitate deflection of the cantilevered section 134, undercuts 135 are provided along the opposite sides of the cantilevered section 134. The outer end of the cantilevered section 134 includes a rib-like projection 136 which projects into the fixing channel 120 and converges to a peak 137 at the tip thereof.

Figure 16:
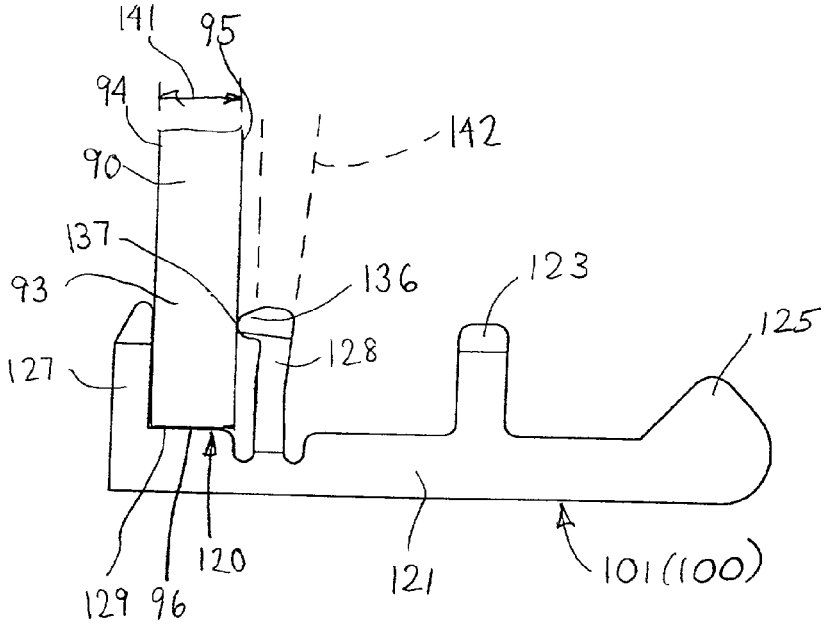
FIG. 16 is a plan view of the vertical edge rail diagrammatically illustrating deflection of one channel wall.

The tip 137 is adapted to contact the interior face 95 of the glass 90 as illustrated in FIG. 16 to effectively define a point contact between the peak 137 and the opposing glass face 95. Furthermore, the projection 136 serves to space the cantilevered section 134 away from the glass face 95 such that upon deflection of the channel wall 128 as diagrammatically illustrated in FIG. 16, the projection 136 continues to be the only portion of the channel wall 128 in contact with the glass 90.

The peak 137 is spaced rearwardly away from the interior surface of the exterior channel wall 127 by a distance indicated by reference arrow 140. The distance 140 is less than the thickness of the glass 90 as indicated by reference arrow 141 in FIG. 16 such that upon insertion of the glass into the fixing channel 120, the thicker dimension of the glass 90 causes the deflectable channel wall 128 to flex outwardly away therefrom. The flexing of the channel wall 128 is generally indicated by dotted line 142 that represents the plane of the back face of the channel wall 128 which noticeably is at an angle relative to the plane of the glass face 95. Since the peak 137 defines a point contact, the gripping force acting on the glass face 95 acts at the peak 137. Therefore, the effective length of the deflectable channel wall 128 is indicated by reference arrow 143 which is the distance between the undercuts 135 and the peak 137.

By providing the undercuts 135, this effective length of the channel wall 128 is increased to make the channel wall 128 more deflectable while at the same time serving to eliminate stress risers which might otherwise occur at the base end 144 of the cantilevered section 134.

With the foregoing arrangement, the glass 90 is tight-fittingly received within the fixing channel 120 and is gripped therein by compression of the glass edge region 93 between the opposing interior surfaces of the exterior channel wall 127 and the deflectable channel wall 128.

The channel walls 127 and 128 are formed of a rigid material, preferably extruded aluminum such that insertion of the glass 90 within the fixing channel 120 causes actual deflection of the channel wall 128. As such, no gaskets are provided within the fixing channel 120.

While the interior surfaces of the channel walls 127 and 128 may be exposed metal, the edge rails 100 and 101 preferably have a coating thereon which coating is a urethane powder coat having a thickness in the range of 3 to 5.5 mills. Due to variations in tolerance in the waviness or the thickness of the glass faces 94 and 95, the powder coating may be shaved off to provide a surface that conforms to variations in the glass surface 95. This ensures continuous contact of the peak 137 with the glass face 95.

More particularly as to FIG. 17, the channel walls 127 and 128 are diagrammatically illustrated therein, each having a respective layer 146 and 147 of a coating, namely the aforementioned powder coating. The opposite faces of the glass 94 and 95 also are diagrammatically illustrated therein wherein waviness or variations in thickness of the glass 90 is illustrated in an exaggerated manner for diagrammatic purposes.

Due to waviness in the glass 90, the coating 146 or 147 may be shaved in isolated areas 148 and 149 which reduces the overall thickness of the powder coating in these shaved or sheared areas 148 and 149. Also, thicker areas 150 and 151 are illustrated having a thickness which is closer to the original thickness of the coatings 146 and 147. Thus, upon insertion of the glass 90 into the fixing channel 120, the glass 90 would not only deflect the channel wall 128 outwardly but also may shave off or shear portions of the coating layer 146 or 147.

Thus, while the coating 146/147 is not required, the coating 146/147 also provides an additional advantage of providing uniform interior surfaces which conforms to the glass faces 94 and 95

For assembly of the glass panel 14, the rail frame 91 is assembled by first assembling the bottom edge rail 99 to the left edge rail 100 into an L-shaped piece, and similarly joining the right edge rail 101 to the upper edge rail 98 into another L-shaped piece. The upper and lower edge rails 98 and 99 are placed on the respective upper and lower edges of the glass to place and locate the side edge rails 100 and 101 next to the side edge regions 93 of the glass 90.

Since the side edge rails 100 and 101 must be forced onto the side glass edges 93, the side edge rails 100 and 101 in the initial stage of assembly are not yet fixed onto the glass edges 93. Once the side edge rails 100 and 101 are positioned relative to the side glass edges 93, an assembly fixture is provided to force fit the side edge rails 100 and 101 onto the glass side edges 93. Thereafter, the two L-shaped pieces are joined together by inserting the remaining corner fasteners 103.

Thereafter, as seen in FIG. 3, the lower edge rail 99 is hooked onto the lower frame member 24 of the panel frame 18 and then the upper end of the glass panel 14 is swung toward the upper frame member 23. During this operation, the side edge rails 100 and 101 fit over the respective side frame members 21 and 22 until the ridges or beads 125 of the side edge rails 100 and 101 fully engage the gaskets 66. Thereafter, the top fastener screws 115 are threaded through the upper edge rail 98 into threaded fixed engagement with the upper frame member 23.

Once the glass panel 14 is installed in place, a wall panel 10 having an improved esthetic appearance is provided. In particular as generally illustrated in FIGS. 1 and 4, the edge frame 91 only has a small reveal of 0.25 inches so that the majority of the surface area of the wall panel 10 is exposed glass. The aesthetic appearance of the wall panel is further improved in that the front and interior faces of the frame members of the panel frame 18 are still visible through the glass as generally illustrated in the upper right corner of FIG. 4.

The above-described wall panel thereby has an improved construction relative to existing glass panel frames.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In an office furniture arrangement having an office furniture component which is positionable in an office area, said office furniture component including a weight-bearing support structure positionable in the office area and a glass panel assembly mounted to said support structure wherein said support structure orients said glass panel assembly relative to a floor of said office area and permits viewing of said glass panel assembly from an exterior of said office furniture component, comprising the improvement wherein said glass panel assembly comprises a sheet of glass defined by a peripheral glass edge and opposite glass faces extending between said glass edge which said glass faces define a thickness of said sheet of glass, said glass panel assembly further including an edge frame which is joined to said peripheral glass edge wherein said edge frame removably connects to said support structure and said edge frame carries the weight of the sheet of glass, said edge frame including an elongate rigid edge rail which extends along said glass edge and rigidly supports said sheet of glass along said glass edge, said edge rail including an elongate fixing channel which extends parallel to and opens toward said glass edge wherein said glass edge is received within said fixing channel, said fixing channel including opposite channel walls which are spaced apart to define a channel opening that is proximate to but is narrower than said thickness of said glass, said channel walls extending generally parallel to said opposite glass faces and being formed of a rigid wall material which defines rigid opposing interior wall surfaces that are rigid and respectively contact said opposite glass faces of said sheet of glass, at least one of said channel walls being resiliently deflectable so as to be deflected by insertion of said glass edge in said channel opening wherein said glass faces are in tight-fitting compressive contact by the rigid opposing interior wall surfaces of said deflectable channel wall and the other of said channel walls to thereby join said sheet of glass to said edge rail.

2. The office furniture arrangement according to claim 1, wherein said glass has a rectangular shape defined by opposite vertical edge sections, and opposite top and bottom horizontal edge sections each of said vertical edge sections being supported along a vertical length thereof by one said fixing channel.

3. The office furniture arrangement according to claim 1, wherein said support structure maintains the glass panel assembly in a fixed orientation.

4. The office furniture arrangement according to claim 1, wherein said edge rail is formed of extruded metal.

5. The office furniture arrangement according to claim 1, wherein said support structure carries a weight of said glass panel assembly.

6. In an office furniture arrangement having an office furniture component which is positionable in an office area, said office furniture component including a weight-bearing support structure positionable within the office area and a glass panel assembly removably mounted to said support structure wherein said support structure orients said glass panel assembly relative to a floor and permits viewing of said glass panel assembly from said office area, comprising the improvement wherein said glass panel assembly comprises a sheet of glass defined by glass edges and opposite glass faces extending between said glass edges which said glass edges define a thickness of said sheet of glass, said glass panel assembly further including an edge frame which is joined to said sheet of glass wherein said edge frame removably connects to said support structure and said edge frame carries the weight of the sheet of glass, said edge frame having rigid edge rails which extend respectively along said glass edges, at least one of said edge rails including an elongate fixing channel which extends parallel to and has an open side that opens toward said respective glass edge wherein said glass edge is received in compression within said respective fixing channel, each said fixing channel including opposite channel walls which are spaced apart to define said open side and which extend generally parallel to said opposite glass faces of said sheet of glass, said channel walls being formed of a rigid wall material which said wall material defines rigid opposing interior wall surfaces between which said respective glass edge is received, said rigid wall material permitting at least one of said channel walls to be resiliently deflectable upon insertion of said respective glass edge in said fixing channel such that said glass faces are in tight-fitting gripping contact with said rigid interior wall surfaces of said deflectable channel wall and the other of said channel walls to thereby join said sheet of glass to said edge rail, each said deflectable channel wall including an elongate rigid projection proximate a distal end thereof which defines one of said rigid interior wall surfaces wherein said projection contacts an opposing one of said glass faces substantially continuously along the length of said edge rail.

7. The office furniture arrangement according to claim 6, wherein said projection converges to a peak which said peak is disposed in direct contact with said respective glass face, said respective glass faces being disposed in compression between said peak of said deflectable channel wall and an opposing interior surface of the other of said channel walls disposed directly opposite to said peak.

8. The office furniture arrangement according to claim 7, wherein at least one of said edge rails is coated with a coating material.

9. The office furniture arrangement according to claim 8, wherein said coating is a shearable material which is removable by said glass edge upon insertion of said glass edge into said respective fixing channel such that said coating conforms to a shape of said glass.

10. The office furniture arrangement according to claim 6, wherein said one of said edge rails with said fixing channel extends along a respective one of said glass edges which extends vertically.

11. In an office furniture arrangement having an office furniture component which is positionable in an office area, said office furniture component including a support structure positionable within the office area and a glass panel assembly attached to said support structure wherein said support structure permits viewing of said glass panel from said office area, comprising the improvement wherein said glass panel assembly comprises a sheet of glass defined by glass edges and opposite faces extending between said glass edges, said glass panel assembly further including an edge frame which is joined to said sheet of glass wherein said edge frame removably connects to said support structure and said edge frame carries the weight of the sheet of glass, said edge frame having edge rail sections which extend respectively along said glass edges, at least one of said edge rail sections including an elongate fixing channel which extends parallel to and opens toward said respective glass edge wherein said glass edge is received within said respective fixing channel, each said fixing channel including opposite channel walls which are spaced apart and extend generally parallel to said opposite glass faces, said channel walls being formed of a rigid wall material which said wall material defines rigid opposing interior wall surfaces between which said respective glass edge is received, said rigid wall material permitting at least one of said channel walls to be resiliently deflectable upon insertion of said respective glass edge in said fixing channel such that said glass edge is in tight-fitting gripping contact with said rigid interior wall surfaces of said deflectable channel wall and the other of said channel walls to thereby fixedly join said sheet of glass to said edge rail, said deflectable channel wall and said other channel wall being joined together by a side wall of said edge rail to define rigid corners of said edge rail, said edge rail having an undercut formed in said edge rail proximate a juncture defined between said deflectable channel wall and said side wall proximate one of said corners.

12. In a space-dividing wall panel having a base frame that defines a periphery of said wall panel, said base frame being defined by elongate frame members which are joined together to define an open interior region between said frame members, said wall panel further including a glass panel assembly which is supported on said base frame to overlie said open interior region while permitting viewing of said glass panel assembly from an exterior of said wall panel, comprising the improvement wherein said glass panel assembly comprises a sheet of glass having glass edges extending about the periphery thereof and opposite faces extending between said glass edges, said glass panel assembly further including an edge frame comprising a plurality of edge rails which said edge frame is joined to said glass to support said glass edges and removably mounts to said base frame to support said sheet of glass on said base frame, at least one of said edge rails including an elongate fixing channel which extends parallel to a respective one of said glass edges and opens toward said respective glass edge to tight-fittingly receive said respective glass edge therein, each said fixing channel including opposite channel walls which are spaced apart and extend generally parallel to said opposite glass faces wherein said channel walls have opposing rigid interior wall surfaces which abut against said opposite glass faces, at least one of said channel walls being deflectable upon insertion of said glass edge therein so that said glass faces are in gripping contact with said rigid interior wall surfaces, said deflectable channel wall including an elongate rigid projection proximate a distal end thereof which defines a respective one of said rigid interior wall surfaces wherein said deflectable channel wall is spaced from said glass face adjacent said projection and is in continuous contact with said opposing glass face through said projection along the length of said projection.

13. The wall panel according to claim 12, wherein said projection converges to a peak which is in continuous contact with said glass face, said respective glass faces being disposed in compression between said peak of said deflectable channel wall and the rigid interior wall surface of the other of said channel walls.

14. The wall panel according to claim 12, wherein said rigid interior wall surfaces define substantially non-compressible hard surfaces.

15. The wall panel according to claim 14, wherein at least one of said channel walls comprises a coating thereon which said coating defines said respective rigid interior wall surface.

16. The wall panel according to claim 15, wherein said coating is a shearable material which is shearable by said glass edge upon insertion of said glass edge into said respective fixing channel such that said coating conforms to a shape of said glass face.

17. The wall panel according to claim 12, wherein said rigid interior wall surface of the other of said channel walls is flat so as to be in rigid face-to-face contact with said respective opposing glass face directly opposite to said projection.

18. In a space-dividing wall panel having a load-bearing panel frame that defines a periphery of said wall panel, said wall panel further including a glass panel assembly which includes an edge frame and a sheet of glass wherein said edge frame is mounted to said panel frame by connector parts, comprising the improvement wherein said glass panel assembly comprises said sheet of glass having glass edges extending about the periphery thereof and opposite faces extending between said glass edges, said glass edges being arranged in substantially parallel edge pairs disposed on opposite sides of said glass, said glass panel assembly further including said edge frame comprising a plurality of edge rails wherein said edge frame is joined to said glass to support said glass edges and said connector parts connect said edge frame to said panel frame to support said glass on said panel frame, said glass edges of at least one of said edge pairs being supported within fixing channels defined within a corresponding pair of said edge rails, each said fixing channel extending parallel to a respective one of said glass edges and opening toward said respective glass edge to tight-fittingly receive said respective glass edge therein, each said fixing channel including opposite channel walls which are spaced apart and extend generally parallel to said opposite glass faces, said channel walls having opposing rigid interior wall surfaces which are rigid and are normally spaced apart a distance less than a thickness of said glass wherein at least one of said channel walls deflects outwardly upon insertion of said respective glass edge within said respective fixing channel with said rigid interior wall surfaces being disposed in rigid contact with said glass faces.

19. The wall panel according to claim 18, wherein said glass has a vertical height and said fixing channels support said glass edges substantially along the entire vertical height of said glass.

20. The wall panel according to claim 18, wherein said edge frame includes said edge rails at a bottom and a top of said glass wherein said bottom and top edge rails are fixed to said panel frame by connector parts.

21. In a space-dividing wall panel having a base frame that defines a periphery of said wall panel, said wall panel further including a glass panel assembly having a sheet of glass and an edge frame joined to said sheet of glass, said edge frame being supported on said base frame by connector parts wherein said base frame vertically supports a weight of said glass panel assembly, comprising the improvement wherein said glass panel assembly comprises said sheet of glass having glass edges extending about the periphery thereof and opposite faces extending between said glass edges, said glass edges being arranged in substantially parallel edge pairs disposed on opposite sides of said glass, said glass panel further including said edge frame comprising a plurality of edge rails joined together which said edge frame is joined to said glass to support said glass edges and includes said connector parts to support said sheet of glass on said base frame, said glass edges of at least one of said edge pairs being supported within fixing channels defined within a corresponding pair of said edge rails, each said fixing channel extending parallel to a respective one of said glass edges and opening toward said respective glass edge to tight-fittingly receive said respective glass edge therein, each said fixing channel including opposite channel walls which are spaced apart and extend generally parallel to said opposite glass faces, said channel walls having opposing rigid interior wall surfaces which are normally spaced apart a distance less than a thickness of said glass wherein at least one of said channel walls deflects outwardly upon insertion of said respective glass edge within said respective fixing channel with said rigid interior wall surfaces being disposed in rigid contact with said glass faces, said deflectable channel wall being spaced outwardly of said opposing glass face and including an elongate rigid projection along a length thereof which projects toward said respective glass face and spans said space therebetween so as to rigidly contact said opposing glass face, said glass faces being disposed in gripping contact between said projection and an opposing one of said rigid interior wall surfaces.

22. In an office furniture arrangement having an office furniture component which is positionable in an office area to separate adjacent work areas, said office furniture component including a glass panel supported thereon, comprising the improvement wherein said glass panel comprises a sheet of glass having glass edges extending about the periphery thereof and opposite faces extending between said glass edges, said glass panel further including an edge frame comprising a plurality of edge rails which said edge frame is joined to said glass to support said glass edges, at least one of said edge rails including an elongate fixing channel which extends parallel to a respective one of said glass edges and opens toward said respective glass edge to tight-fittingly receive said respective glass edge therein, each said fixing channel including opposite channel walls which are spaced apart and extend generally parallel to said opposite glass faces wherein said channel walls have opposing interior wall surfaces which face toward and abut against both of said opposite glass faces, at least one of said interior wall surfaces further including a coating thereon which is shearable by said glass edge upon insertion of said glass edge into said respective fixing channel such that said coating conforms to a shape of said glass face and said channel walls are in gripping contact with said glass edge.

23. The office furniture arrangement according to claim 22, wherein said coating is a powder coating.

24. The office furniture arrangement according to claim 23, wherein said edge rails are defined by extruded metal to define said fixing channel.

25. The office furniture arrangement according to claim 22, wherein at least one of said channel walls is resiliently deflectable and is in a deflected position when said glass edge is received within said fixing channel.

26. The office furniture arrangement according to claim 25, wherein said glass has opposite vertical side edge sections, said glass edges of said side edge sections being received within said fixing channels of said edge rails wherein said edge rails extend vertically.

27. In an office furniture arrangement having an office furniture component which is positionable in an office area, said office furniture component including a glass panel supported thereon, comprising the improvement wherein said glass panel comprises a sheet of glass having a glass edge extending about the periphery thereof and opposite faces extending between said glass edge, said glass panel further including an edge rail which said edge rail is joined to said glass to support said glass edge, said edge rail including an elongate fixing channel which extends parallel to said glass edge and opens toward said glass edge to tight-fittingly receive said glass edge therein, each said fixing channel including opposite channel walls which are spaced apart and extend generally parallel to said opposite glass faces wherein said channel walls have opposing interior wall surfaces which abut against said opposite glass faces, at least one of said interior wall surfaces further including a powder coating thereon which is shearable by said glass edge upon insertion of said glass edge into said respective fixing channel such that said coating conforms to a shape of said glass face and said glass edge is in gripping contact with said channel walls.

* * * * *